US007911152B2

(12) United States Patent
Yanai et al.

(10) Patent No.: US 7,911,152 B2
(45) Date of Patent: Mar. 22, 2011

(54) HIGH FREQUENCY ELECTRONIC BALLAST FOR HIGH INTENSITY DISCHARGE LAMPS AND IMPROVED DRIVE METHOD THEREFOR

(75) Inventors: Yigal Yanai, Givatayim (IL); Yuri Yakub, Ofaqim (IL)

(73) Assignee: Metrolight Ltd., Netanya (IL)

( * ) Notice: Subject to any disclaimer, the term of this patent is extended or adjusted under 35 U.S.C. 154(b) by 1162 days.

(21) Appl. No.: 11/559,897

(22) Filed: Nov. 15, 2006

(65) Prior Publication Data

US 2008/0111497 A1 May 15, 2008

(51) Int. Cl.
*H05B 37/02* (2006.01)

(52) U.S. Cl. ..... 315/291; 315/307

(58) Field of Classification Search ..... 315/209 R, 315/224, 225, 291, 307, 111.01, 111.21, 315/111.71, 111.81, 111.91
See application file for complete search history.

(56) References Cited

U.S. PATENT DOCUMENTS 4,557,700 A * 12/1985 Rothwell et al. ..... 445/53
5,468,955 A * 11/1995 Chen et al. ..... 250/251
6,400,100 B1 * 6/2002 Kramer ..... 315/291
6,791,285 B2 * 9/2004 Greenwood et al. ..... 315/307
6,927,636 B2 * 8/2005 Deng et al. ..... 331/3
7,157,867 B2 * 1/2007 Stockwald ..... 315/360
7,221,231 B2 * 5/2007 Camparo et al. ..... 331/94.1
2006/0158123 A1 * 7/2006 Clavier ..... 315/77

* cited by examiner

*Primary Examiner* — Jacob Y Choi
*Assistant Examiner* — Jimmy T Vu

(57) ABSTRACT

A ballast for operating a high intensity discharge (HID) lamp includes a mechanism which provides electrical power to the HID lamp and a frequency-selecting mechanism which selects a frequency of the electrical power based on an atomic component present in the HID lamp. Preferably, the frequency is selected within a range between two hundred kilohertz and nine hundred kilohertz. Preferably, the frequency is near two hundred kilohertz and the operation enhances radiant efficiency at blue-green wavelengths due to excitation states of: scandium, indium, thallium and rare earth elements. Preferably, when the operation frequency is near seven hundred kilohertz, the operation enhances radiant efficiency at red wavelengths due to excitation states of atomic components selected from alkali metals. Preferably, the ballast includes a dimming mechanism for dimming the HID lamp thereby reducing said electrical power, and upon the dimming, the frequency-selecting mechanism selects the frequency for optimizing color parameters and luminous flux of the radiant emission.

22 Claims, 4 Drawing Sheets

HIGH FREQUENCY ELECTRONIC BALLAST FOR HIGH INTENSITY DISCHARGE LAMPS AND IMPROVED DRIVE METHOD THEREFOR

CROSS REFERENCE TO RELATED APPLICATIONS

Not Applicable

FIELD AND BACKGROUND OF THE INVENTION

The present invention relates to operating gas discharge lamps and, more particularly, to operating high intensity discharge (HID) lamps at high frequencies Specifically, the method includes enhancing performance of high intensity discharge lamps by operating at frequencies higher than conventionally used in prior art systems, the frequency of operation is based on excited components in the discharge.

HID lamps produce light by striking an electrical arc across electrodes housed inside a fused quartz or fused alumina arc chamber. The chamber encloses specific components such as mercury vapor, metal halide, alkali and rare earth metals which are selected based on the wavelength of the radiant emission of the excited states of the metallic components.

Standard low-pressure sodium lamps have the highest efficiency of all HID lamps, but they produce a yellowish light. High-pressure sodium lamps that produce a whiter light, but efficiency is somewhat sacrificed. Metal halide lamps are less efficient but produce an even whiter, more natural light. High-intensity discharge (HID) lamps, typically require power supplied by either magnetic or electronic ballasts. Magnetic ballasts provide electrical power to the HID lamp during normal steady-state operation typically at power line frequency, e.g. 50-60 Hz and electronic ballasts provide electrical power to the HID lamp typically at a low-frequency, e.g. 120 to 200 Hz square wave, quasi-sine, pure sine wave or rectangular waveform.

High intensity discharge (HID) gas discharge lamps suffer from acoustic resonances when HID lamps are operated at high frequencies, i.e., between a few kHz to about two hundred kHz, depending on the dimensions of the lamp. Acoustic resonance causes the radiant arc within the lamp to gyrate, flicker, and even be extinguished. However, when the lamps are operated at high frequencies, i.e., above the highest acoustic resonance which depends on the dimensions of the lamp (e.g. ~50 120 kHz for a 400 W metal halide lamp, lamp performance is not adversely affected. Consequently, there are manufacturers of HID electronic ballasts which power the lamp with high-frequency power, at frequencies just beyond the acoustic resonance range. Such ballasts operate typically at frequencies of 100 to 150 kHz. The frequency of high frequency electronic ballasts is conventionally selected to be high enough to avoid acoustic resonances, but not so high as to increase cost and complexity of the ballast circuit.

In lighting applications, even a small increase, e.g. a few per cent in efficiency or luminous flux translates into considerable electrical energy savings.

There is thus a need for, and it would be highly advantageous to have a system and method of enhancing performance of high intensity discharge lamps by operating at a frequency higher than that conventionally used in prior art systems to increase the efficiency of the operation.

The Commission on Color) dm is C.I.E. (Commission Internationale de l'Eclairage, the International based on mixing different proportions of three hypothetical primary colors (e.g. red green and blue) which create the sensation in a human observer, of any color of light. The three "primary" colors are dubbed "X," "Y" and "Z." In order to specify color and not brightness, the relative strengths of the three primary colors are denoted by x, y and z. Since x+y+z must add up to 1 (i.e. 100%) providing x and y is sufficient to specify lamp color; the z value is implied Lamp color is represented on a two-dimensional plot of x and y. All possible colors then fall inside a "color triangle" or chromaticity diagram in which the perimeter encompasses spectrally pure colors (e.g. in rainbows and prisms) ranging from red to blue. A chromaticity diagram is shown in FIG. 1. Moving toward the center "dilutes" the color until the ultimately becomes "white". Specifying the x,y coordinates locates a color on the color triangle. The color points traversed by an incandescent object (e.g. a standard tungsten lamp) as temperature of the lamp filament is raised can be plotted on the CIE Chromaticity diagram as the "Blackbody curve". A standard incandescent lamp has a filament at a temperature 2700 degrees Kelvin, and therefore by definition a color temperature of 2700 Kelvins.

The Kelvin system for describing lamp color works well for incandescent lamps, since incandescent lamps are nearly black body radiators, their chromaticity coordinates land directly on the Planckian locus in the CIE x,y color space. The Planckian locus is shown in FIG. 1. Gas discharge and fluorescent lamps, which are not incandescent do not generally produce illumination described by a point in color space which lies on the Planckian locus in the chromaticity diagram.

Color of illumination from gas discharge aid fluorescent lamps is described using "correlated color temperature" (CCT), which assigns a color temperature to a color near, but not on, the Planckian locus. Two lamps whose x,y co-ordinates fall one above the blackbody curve and one below could have the same CCT. However, the one above will appear slightly greener, and the one below slightly pinker. The rated CCT of a discharge or fluorescent lamp tube does not completely specify the color of the illumination.

The CIE developed a newer model for rating light sources, called the color rendering index, which is a mathematical formula describing lamp illumination as compared with the illumination provided by a reference source. Color rendering Index (CRI) is a measure of how closely the lamp renders colors of objects compared to the reference standard source. Daylight is considered a standard but then so also is any "blackbody," i e., any incandescent object, no matter what its temperature. Based on this definition, daylight and all incandescent and halogen sources have CRI of 100 which is the maximum value. For a warm lamp, CRI is a measure of how close to incandescent the color is; for a very cool lamp CEI is a measure of how close to daylight the color is. Lamps with distorted colors have a low CRI. In general, the higher the CRI the more natural the appearance of the source and the richer colors appear. In general, a CRI of less than ~50 is not considered acceptable in the market.

Luminous flux is a quantitative expression of the brilliance of a source of visible light which is electromagnetic energy within the wavelength range of approximately 390 nanometers (nm) to 770 nm. This quantity is measured in terms of the power emitted per unit solid angle from an isotropic radiator, a theoretical point source that radiates equally in all directions in three-dimensional space.

The standard unit of luminous flux is the lumen (lm). Reduced to base units in the International System of Units (SI), 1 lm is equivalent to 1 candela steradian (cd sr). This is the same as 1.46 milliwatt of radiant power at a wavelength of 555 nm which lies in the middle of the visible spectrum.

Ref: http://en.wikipedia.org/wiki/Correlated_color_temperature,/Planckian_locus

The term "near" as used herein referring to a operating frequency, is within ten per cent of the operating frequency.

The term "atomic" component refers to atoms added into the chamber of a discharge lamp although the atoms are in ionic form as in a compound, e.g. Lithium Iodide.

SUMMARY OF THE INVENTION

According to the present invention, there is provided a ballast for operating a high intensity discharge (HID) lamp including a mechanism which provides electrical power to the HID lamp and a frequency-selecting mechanism which selects a frequency of the electrical power based on an atomic component present in the HID lamp. Preferably, the frequency is selected within a range between two hundred kilohertz and nine hundred kilohertz. Preferably, when the frequency is near two hundred kilohertz, the operation enhances radiant efficiency at blue-green wavelengths due to increased excitation states of scandium, indium, thallium and rare earth elements. Preferably, when the operation frequency is near seven hundred kilohertz, the operation enhances radiant efficiency at red wavelengths due to increased excitation states of alkali metals. Preferably, the ballast includes a dimming mechanism for dimming the HID lamp thereby reducing said electrical power, and upon the dimming, the frequency-selecting mechanism selects the frequency for optimizing a property of a radiant emission from the HID lamp. Preferably, the optimized property is selected from the group consisting of color parameters of the radiant emission and luminous flux of the radiant emission. Color temperature is preferably stabilized due to increased excitation states of the atomic components selected from alkali metals, when the frequency of operation is near seven hundred kilohertz.

According to the present invention there is provided a method of operation of a high intensity discharge (HID) lamp. The HID lamp includes a chamber which encloses atomic components. A frequency of operation is selected based on the atomic components. A ballast is attached to the HID lamp and operates the HID lamp by powering at the selected frequency, by exciting the atomic components causing visible light to radiate from the chamber. Preferably, the frequency is a plasma oscillation frequency of the atomic component when charged during said excitation. Preferably, the frequency is substantially above a highest acoustic resonant frequency of the HID lamp. Preferably, the atomic components include lithium and the frequency is near seven hundred kilohertz and/or the atomic components include scandium and the frequency is near two hundred kilohertz. Preferably, the frequency is near two hundred kilohertz and the operation enhances radiant efficiency at blue-green wavelengths due to excitation states of the atomic component consisting of: scandium, indium, thallium and rare earth elements. Preferably, when the operation frequency is near seven hundred kilohertz, the operation enhances radiant efficiency at red wavelengths due to excitation states of atomic components selected from alkali metals. Preferably, when dimming by decreasing power to the HID lamp during the operation, and changing the frequency based on the atomic components, the frequency is further selected based on color parameters of the visible light. When the frequency is near seven hundred kilohertz, the operation stabilizes at least one property either color temperature and/or color rendering index, due to increased excitation states of the atomic component selected from alkali metals.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
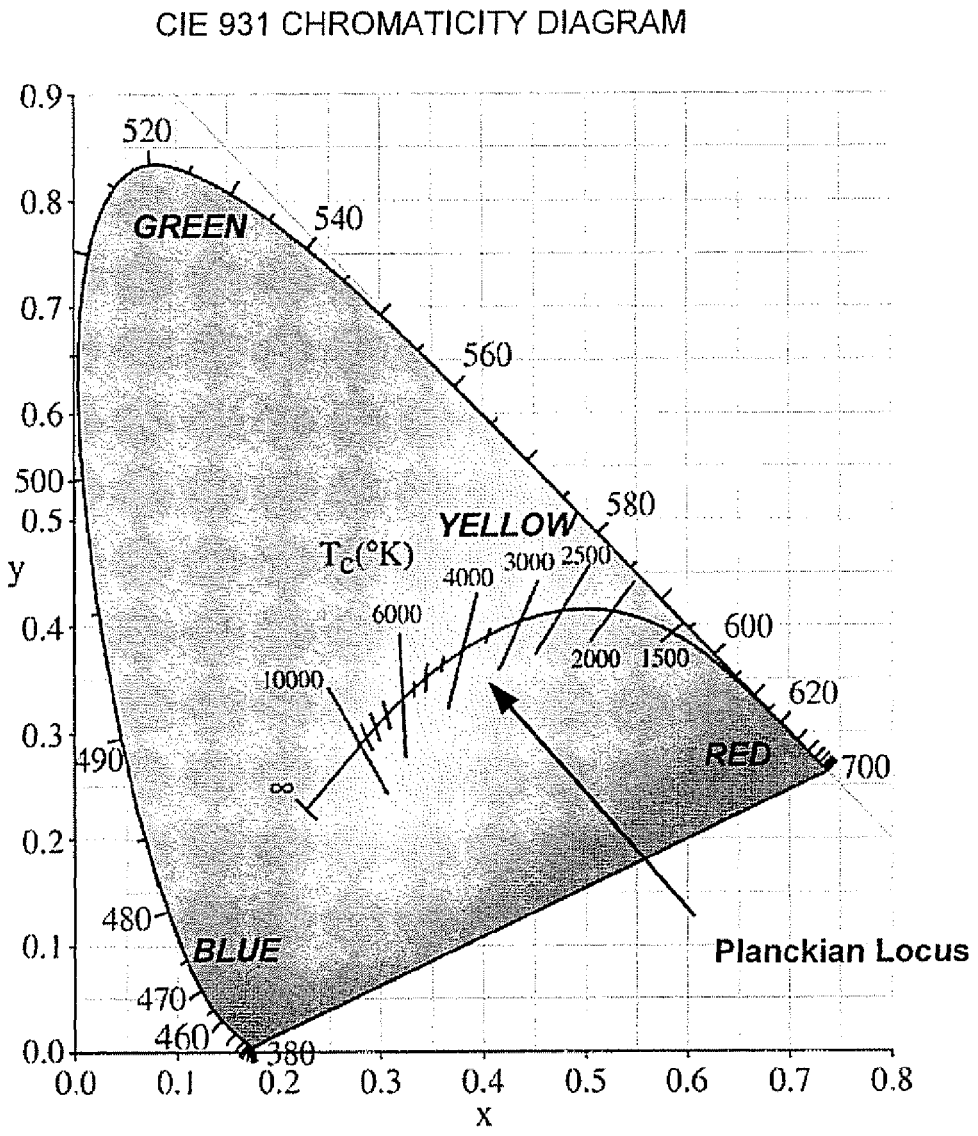
FIG. 1 Background Art
FIG. 1 is a prior art drawing of a C.I.E. chromaticity diagram.

The present invention is of a system and method of operating a gas discharge lamp at a frequency which improves the lamp efficiency. Specifically, the system and method includes operating power high intensity discharge (HID) lamps at a high-frequency power, selected to coincide with an oscillating frequency of a charged species of metallic components the gases inside the arc-chamber of the discharge lamp.

Oscillation frequency of a charged species for a radiant plasma is approximated by the following formula:

$$f = \frac{N}{e_0 M}^{\frac{1}{2}} Ze$$

where f is oscillation frequency (Hz),

N volume density ($m^3$),

M is mass (kg)

e is electron charge $1.60 \cdot 10^{-19}$ coulombs $e_o$ is dielectric constant or permittivity of a vacuum, $8.854185 \times 10^{-12}$ farads/meter N~$1 \cdot 10^{20}$ $10^{21}$ $m^{-3}$ for additive atomic components such as $Sc^{3+}$, $In^{3+}$ or $Tl^{1+}$, Sc, In, Tl or rare earth metals and alkali metals. Z is the degree of ionization of the components. In particular, in metal halide lamps major emitting species are excited metal atoms, but not all the excited metal atoms are ionized. The excitation state (not ionized) lasts only about $10^{-8}$ seconds. Therefore, the degree of ionization Z is approximately $10^{-4}$-$10^{-5}$. Consequently, estimated resonance oscillation frequencies are on the order of hundreds of kilohertz.

The principles and operation of a system and method of selecting an operation frequency which enhances performance of a gas discharge lamp, according to the present invention, may be better understood with reference to the drawings and the accompanying description.

Before explaining embodiments of the invention in detail, it is to be understood that the invention is not limited in its application to the details of design and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

It should be noted, that although the discussion herein relates to measurements using a specific commercially available HID lamp, the present invention may, by non-limiting example, alternatively be configured as well using a wide variety of discharge lamps.

By way of introduction, principal intentions of the present invention are to operate an HID lamp at a selected frequency based on the oscillation frequency of the specific excited atomic components within the discharge and provide a higher luminous flux, i.e. higher efficiency and provide an adequate or improved perceived color parameters of the emitted visible radiation.

Further the mechanism for frequency selection and dimming may be of any such mechanisms known in the art. It should be further noted that the principles of the present invention are equally applicable across the full range of lamp types, dimensions and rated powers. The present invention is most applicable when the selected frequencies based on oscillation frequency of the specific excited atomic components do not coincide with the acoustic resonant frequencies of the lamp during operation.

Reference is now made to FIG. 1, which illustrates a block diagram of an electronic ballast circuit 10, according to an embodiment of the present invention. High frequency ballast circuit 10 includes a rectifier circuit 101 followed by a power factor control circuit 103 followed by either a "half bridge" or a "full bridge" inverter circuit 105 operated at a selected high frequency. The frequency of operation is selected and controlled by software 107 in microprocessor 109, by outputting a control voltage from a digital to analog converter 117 to a voltage controlled oscillator (VCO) 111. VCO 111 chances the output inverter frequency to a gas discharge lamp 113.

Results

Figure 2:
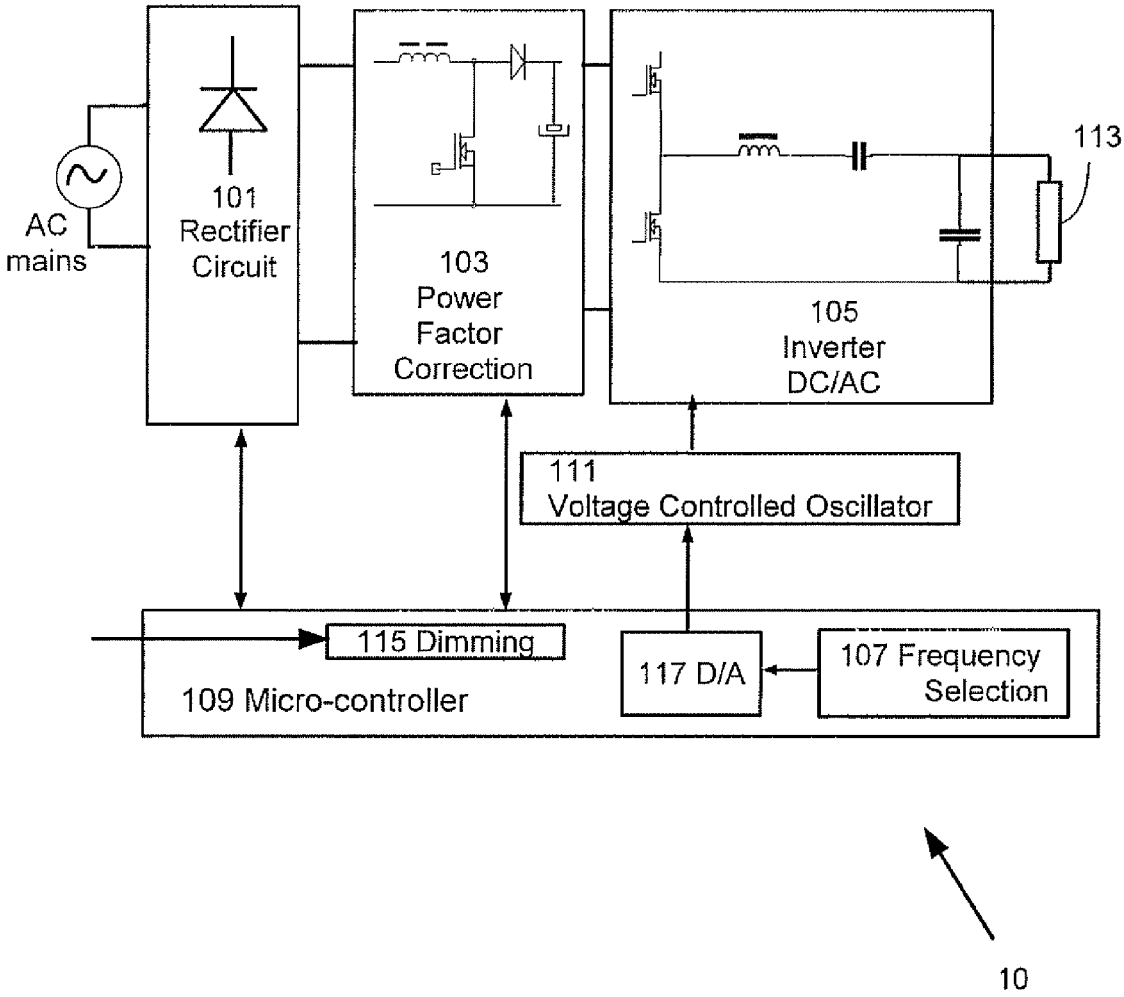
FIG. 2 is a simplified block diagram, according to an embodiment of the present invention of a ballast for powering a regular HID lamp.
Figure 3:
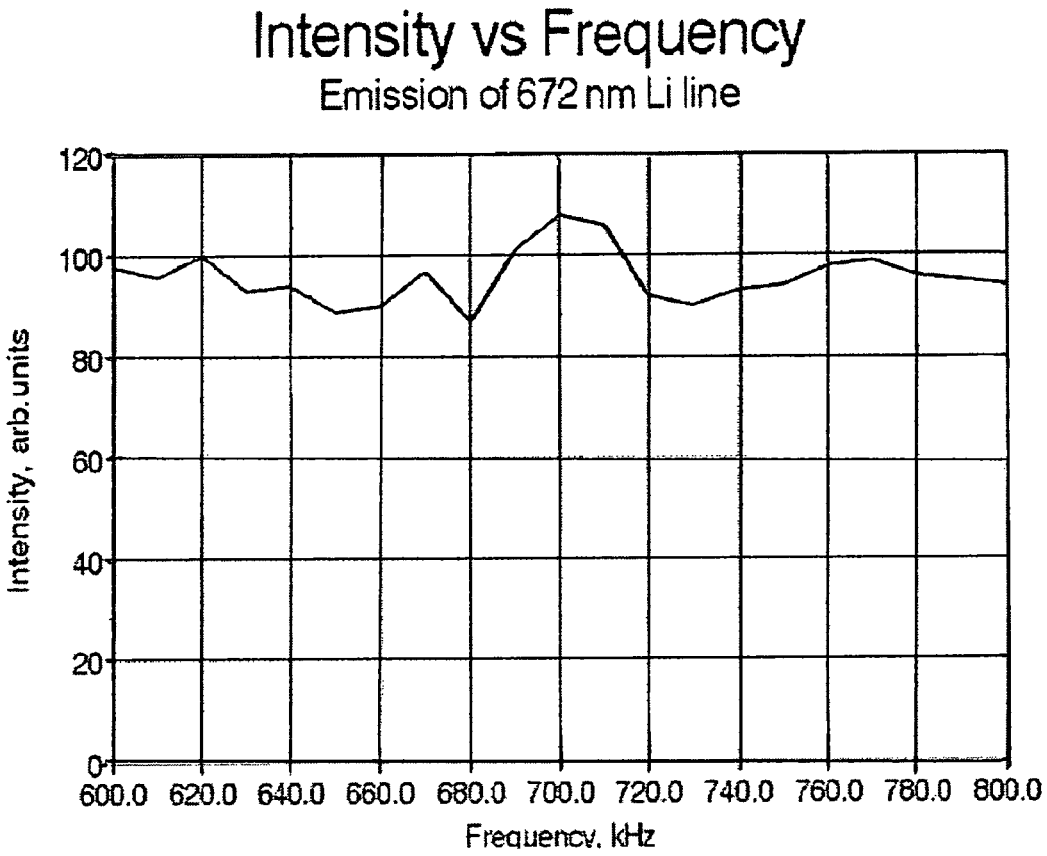
FIG. 3 is a graph of a radiant emission of lithium at 672 nm from a regular HID lamp as a function of drive frequency.
Figure 4:
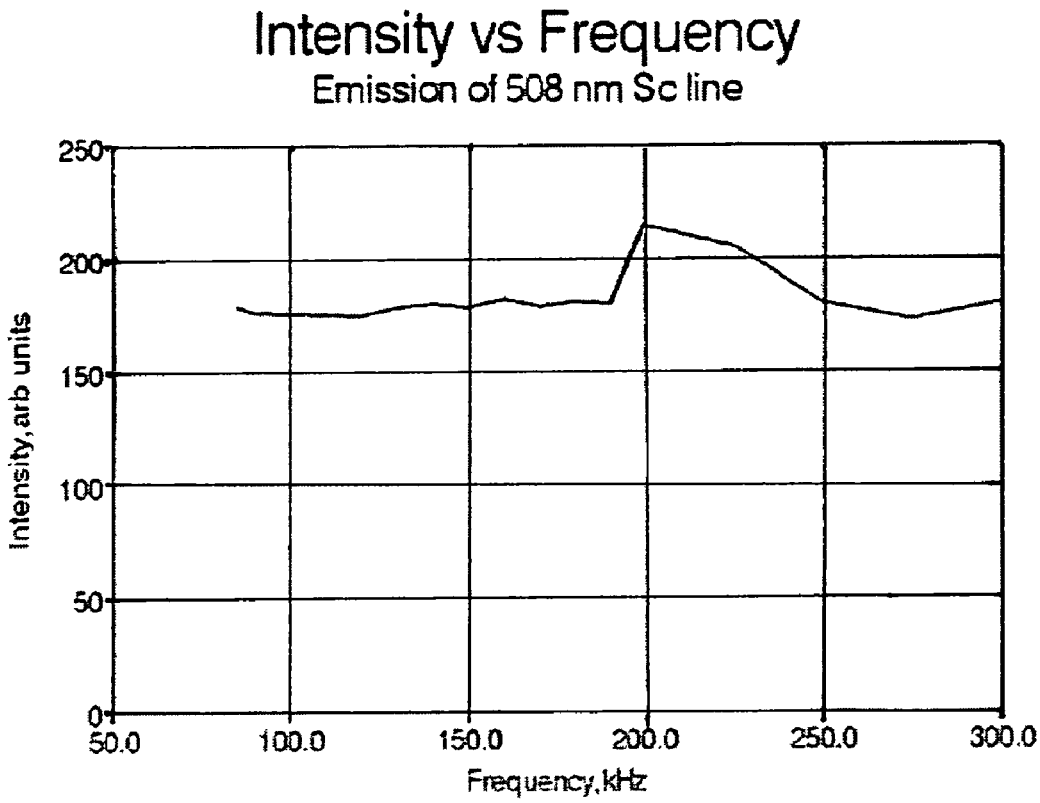
FIG. 4 is a graph of a radiant emission of scandium at 508 nm from a regular HID lamp as a function of drive frequency.

Reference is now made to FIGS. 2 and 3 which are graphs of radiometric lamp performance using ballast circuit 10. Frequency of operation is controlled using frequency control 107. Radiation is measured using Newport optical power meter/Oriel monochromator from a 400 W HID lamp Model Number M400U/BU Metalarc manufactured by Osran/Sylvania. All data were obtained with the operating position of the lamp being vertical base up. Acoustic resonance of the lamp under test is approximately 80-100 Khz.

The graph of FIG. 2 shows a significant increase in measured intensity at 700 kHz of the 672 nm lithium line compared with other operation frequencies. The graph of FIG. 3 shows a significant increase in performance at 200 khz of the 508 nm scandium line compared with other operation frequencies. Both lithium and scandium are present (as halides) in the gas of the lamp wider test.

Photometric performance of the same lamp was measured inside a 1.5 m integrating sphere interfaced to a spectroradiometer SPR-920D. The optical system was calibrated with a tungsten standard lamp, its lumen calibration traceable to CIE conditions. Test results are listed of six cases using the same lamp as above are presented as follows.

| Test Results 1 | |
|---|---|
| Lamp wattage | 400 W |
| Frequency of steady-stage alternating voltage | 50-60 Hz |
| Luminous flux | 38109 Lm |
| Correlated color temperature | 3512 K |
| Color rendering index | 65 |

| Test Results 2 | |
|---|---|
| Lamp wattage | 400 W |
| Frequency of steady-stage alternating voltage | 200-220 kHz |

-continued

| Test Results 2 | |
|---|---|
| Luminous flux | 42078 Lm |
| Correlated color temperature | 3683 K |
| Color rendering index | 68 |

| Test Results 3 | |
|---|---|
| Lamp wattage | 400 W |
| Frequency of steady-stage alternating voltage | 700-720 kHz |
| Luminous flux | 39991 Lm |
| Correlated color temperature | 3471 K |
| Color rendering index | 67 |

| Test Results 4 | |
|---|---|
| Lamp wattage | 200 W at 50% of rated power |
| Frequency of steady-state alternating voltage | 50-60 Hz |
| Luminous flux | 14884 Lm |
| Correlated color temperature | 5356 K |
| Color rendering index | 42 |

| Test Results 5 | |
|---|---|
| Lamp wattage | 200 W at 50% of rated power |
| Frequency of steady-state alternating voltage | 700-720 kHz |
| Luminous flux | 16783 Lm |
| Correlated color temperature | 3892 K |
| Color rendering index | 61 |

| Test Results 6 | |
|---|---|
| Lamp wattage | 200 W at 50% of rated power |
| Frequency of steady-state alternating voltage | 200-220 kHz |
| Luminous flux | 15023 Lm |
| Correlated color temperature | 4873 K |
| Color rendering index | 49 |

Discussion

On comparing test results 1 with test results 2, the lamp in 2 is operated at 200 khz and the lamp in 1 is operating at 50 Hz. Operation 2 at 200 khz is clearly preferable both in terms of color (hue is less red and more white based on the measured color temperature and the measured color rendering index) and in terms of luminous flux. On comparing test results 3 to test results 2, operation at 200 kHz is also preferable to operation at low frequency in terms luminous flux and the color temperature and color rendering index are similar in both 2 and 3.

Test results 4 show that on dimming by 50% to 200 W, using dimming control 115, of ballast circuit 10, operation at 50-60 Hz results in a low color rendering index (bluish hue) while in test results 5 dimmed operation at 700 kHz greatly improves both the color parameters and the luminous flux. Finally test results 6 show that on dimming to 200 W, operation at 200 Khz is marginally unacceptable in terms of color parameters and luminous flux is less than in test results 6. Hence on dimming, operation at 700 Khz is preferred while at full power operation at 200 Khz is preferred. By operating the gas discharge lamp at frequencies corresponding closely to oscillation frequencies of the charged species for a radiant plasma of the discharge, the light-emission contributed by the various additive components, e.g. lithium and scandium of the HID lamp is enhanced, efficiency in terms of lumen/electrical watt of the HID lamp is increased and acceptable color parameters may be achieved even while dimming. According to a particular feature of the present invention the steady-state alternating voltage that drives the metal halide lamp is in the frequency range 220-900 kHz. This high frequency range results in a distinct and surprising improvement in photometric performance of lamp 113 over the wavelength range of interest, i.e. visible range. Without in any way limiting the scope of the present invention, it is believed that this improved photometric performance is due to the following factors. Firstly, high frequency 180-900 kHz steady-state alternating voltage results in increased excitation state of radiating atoms being in vapor phase during the operation of lamp. Secondly, it has been discovered that 200-220 kHz range of high frequency is effective to enhance the radiant efficiency within blue-green wavelength band of the visible spectrum This effect is believed to be due to the increased excitation state of Sc, In, Tl and rare earth metals components in metal halide lamps by operation at 200-220 kHz. Enhanced radiant efficiency results from the above-mentioned components emitting in the blue-green part of the visible spectrum. Thirdly, it has been discovered that operation in a frequency range 700-720 kHz frequency range is also effective to enhance the radiant efficiency within particularly important red wavelength band of visible spectrum. This effect is believed to be due to the additional excitation of alkali metal components of filler composition in metal halide lamps by high frequency range 700-720 kHz. This results in enhanced radiant efficiency of alkali metal atoms emitting in red part of VS spectrum that is very important for dimming mode operation of MH lamps.

According to a particular feature of embodiments of the present invention the steady-state operational alternating voltage lies in the range 180-900 kHz. Operation in frequency range 180-900 kHz results in a distinct and surprising improvement in photometric performance of metal halide lamp over the wavelength range of interest, i.e. visible spectral range. Without in any way limiting the scope of the present invention, it is believed that the improved photometric performance is due to the following factors. First, high frequency 180-900 kHz steady-state operational alternating voltage results in increased excitation state of radiating atoms being in vapor phase during the operation of lamp 113. Secondly, it has been discovered that 200-220 kHz range of high frequency is effective to enhance the radiant efficiency within blue-green wavelength band of the visible spectrum due to the increased excitation state of Sc, In, Tl and rare earth metals components of metal halide lamps, enhancing radiant efficiency of above-mentioned components emitting in the blue-portion of the visible spectrum. Thirdly, it has been discovered that operation in the frequency range 700-720 kHz range is also effective to enhance the radiant efficiency within a particularly important red wavelength band of the visible spectrum, due to the additional excitation of alkali metal components of metal halide lamps. Enhanced radiant efficiency of alkali metal atoms emitting in the red position of the visible spectrum is important for dimming operation of metal halide lamps.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

While the invention has been described with respect to a limited number of embodiments, it will be appreciated that many variations, modifications and other applications of the invention may be made.

What is claimed is:

1. A ballast for operating a high intensity discharge (HID) lamp, the ballast comprising:

(a) a mechanism which provides electrical power to the HID lamp;

(b) a frequency-selecting mechanism which selects a frequency of said electrical power based on at least one atomic component present in the HID lamp, wherein said frequency is a plasma oscillation frequency of said at least one atomic component when charged during excitation, wherein said frequency is an oscillation frequency for a radiant plasma, wherein said oscillation frequency is proportional to the charge of an electron and the degree of ionization of said at least one atomic component when charged during excitation.

2. The ballast, according to claim 1, wherein said frequency is an oscillation frequency for a radiant plasma approximated by a formula:

$$f = \frac{N}{e_0 M}^{\frac{1}{2}} Ze$$

wherein N is the density per unit volume of said at least one atomic species, $e_o$ is the permittivity of a vacuum, M is the mass of said at least one atomic component, Z is the degree of ionization of said at least one atomic component and e is the charge of an electron.

3. The ballast, according to claim 1, wherein said frequency is selected within a range between two hundred kilohertz and nine hundred kilohertz.

4. The ballast, according to claim 1, wherein radiant efficiency of the ballast is enhanced at blue-green wavelengths due to an increased excitation state of said at least one atomic component selected from the group consisting of: scandium, indium, thallium and rare earth elements.

5. The ballast, according to claim 4 wherein said frequency is near two hundred kilohertz.

6. The ballast, according to claim 1, wherein radiant efficiency of said ballast is enhanced at red wavelengths due to an increased excitation state of said at least one atomic component selected from alkali metals.

7. The ballast, according to claim 6, wherein said frequency is near seven hundred kilohertz.

8. The ballast, according to claim 1, further comprising:

(c) a dimming mechanism for dimming said HID lamp thereby reducing said electrical power, wherein upon said dimming, said frequency-selecting mechanism selects said frequency for optimizing at least one property of a radiant emission from the HID lamp.

9. The ballast, according to claim 1, wherein color rendering index is stabilized due to an increased excitation state of said at least one atomic component selected from alkali metals.

10. The ballast, according to claim 9, wherein said frequency is near seven hundred kilohertz.

11. The ballast, according to claim 1, wherein color temperature is stabilized due to an increased excitation state of said at least one atomic component selected from alkali metals.

12. The ballast, according to claim 11, wherein said frequency is near seven hundred kilohertz.

13. The ballast, according to claim 1, wherein said at least one property is selected from the group consisting of color parameters of said radiant emission and luminous flux of said radiant emission.

14. A method of operation of a high intensity discharge (HID) lamp including a chamber enclosing at least one atomic component, the method comprising the steps of:

selecting a frequency of the operation based on the at least one atomic component; and attaching a ballast to the HID lamp and operating the HID lamp by powering at said frequency, thereby exciting said at least one atomic component causing visible light to radiate from said chamber, wherein said frequency is a plasma oscillation frequency of the at least one atomic component when charged during said exciting, wherein said frequency is an oscillation frequency for a radiant plasma, wherein said oscillation frequency is proportional to the charge of an electron and the degree of ionization of said at least one atomic component when charged during excitation.

15. The method, according to claim 14, wherein said frequency is substantially above a highest acoustic resonant frequency of the HID lamp.

16. The method, according to claim 14, wherein said at least one atomic component includes lithium and said frequency is near seven hundred kilohertz.

17. The method, according to claim 14, wherein said at least one atomic component includes scandium and said frequency is near two hundred kilohertz.

18. The method, according to claim 14, wherein said frequency is near two hundred kilohertz and said operating enhances radiant efficiency at blue-green wavelengths due to increased excitation states of said at least one atomic component selected from the group consisting of: scandium, indium, thallium and rare earth elements.

19. The method, according to claim 14, wherein said frequency is near seven hundred kilohertz and said operating enhances radiant efficiency at red wavelengths due to an increased excitation state of said at least one atomic component selected from alkali metals.

20. The method, according to claim 14, further comprising the step of:

dimming by decreasing power to said HID lamp during said operating, and selecting said frequency is further based on color parameters of said visible light.

21. The method, according to claim 14, wherein said frequency is near seven hundred kilohertz and said operating stabilizes at least one property due to an increased excitation state of said at least one atomic component selected from alkali metals; wherein said at least one property is selected from the group consisting of color temperature and color rendering index.

22. The method according to claim 14, wherein said at least one atomic component is selected from the group consisting of: alkali metals, scandium, indium, thallium and rare earth elements.

* * * * *